US009976546B2

(12) United States Patent
Ishii et al.

(10) Patent No.: US 9,976,546 B2
(45) Date of Patent: May 22, 2018

(54) ELECTROMAGNETIC VIBRATING DIAPHRAGM PUMP

(75) Inventors: Hideki Ishii, Osaka (JP); Tsuyoshi Takamichi, Osaka (JP)

(73) Assignee: TECHNO TAKATSUKI CO., LTD. (JP)

( * ) Notice: Subject to any disclaimer, the term of this patent is extended or adjusted under 35 U.S.C. 154(b) by 344 days.

(21) Appl. No.: 14/009,777

(22) PCT Filed: Apr. 9, 2012

(86) PCT No.: PCT/JP2012/059649
§ 371 (c)(1),
(2), (4) Date: Oct. 3, 2013

(87) PCT Pub. No.: WO2012/141126
PCT Pub. Date: Oct. 18, 2012

(65) Prior Publication Data

US 2014/0023533 A1 Jan. 23, 2014

(30) Foreign Application Priority Data

Apr. 15, 2011 (JP) ..... 2011-091462

(51) Int. Cl.
*F04B 43/04* (2006.01)
*F04B 45/04* (2006.01)
(Continued)

(52) U.S. Cl.
CPC ..... *F04B 45/04* (2013.01); *F04B 35/045* (2013.01); *F04B 39/121* (2013.01);
(Continued)

(58) Field of Classification Search
CPC .... F04B 17/045; F04B 17/044; F04B 17/046; F04B 17/048; F04B 17/042; F04B 43/02;
(Continued)

(56) References Cited

U.S. PATENT DOCUMENTS 5,820,772 A * 10/1998 Freitag ..... F04B 43/06 222/591
6,055,898 A 5/2000 Rinninger
(Continued)

FOREIGN PATENT DOCUMENTS

EP 0910745 4/1999
JP 5490607 A 7/1979
(Continued)

OTHER PUBLICATIONS

International Search Report, App PCT/JP2012/059649 dated Jul. 17, 2012.
(Continued)

*Primary Examiner* — Devon Kramer
*Assistant Examiner* — Thomas Cash
(74) *Attorney, Agent, or Firm* — Perman & Green, LLP

(57) ABSTRACT

An electromagnetic vibrating diaphragm pump capable of increasing pump efficiency by increasing the vibration amplitude of the vibration of diaphragms even when the pressure inside a compression chamber is high. Diaphragms are fixed to both end portions of an oscillator having magnets. AC driven electromagnets are provided in a manner to face the magnets of the oscillator. A frame adhered to the outer peripheries of the diaphragms covers the electromagnet side, and pump casings cover the opposite sides. The pump casing includes a compression chamber adjacent to the diaphragm, a suction chamber connected to the compression chamber via a suction valve and an exhaust chamber connected to the compression chamber via an exhaust valve, the suction chamber or the exhaust chamber being connected to the frame via a continuous hole.

8 Claims, 5 Drawing Sheets

(51) Int. Cl.

| | |
|---|---|
| ***F04B 39/12*** | (2006.01) |
| ***F04B 17/03*** | (2006.01) |
| ***F04B 35/04*** | (2006.01) |
| ***F04B 43/02*** | (2006.01) |
| ***F04B 45/047*** | (2006.01) |

(52) U.S. Cl.
CPC ..... *F04B 43/026* (2013.01); *F04B 45/047* (2013.01); *F04B 17/03* (2013.01); *F04B 39/123* (2013.01); *F04B 43/04* (2013.01); *F04B 45/043* (2013.01)

(58) Field of Classification Search
CPC .... F04B 43/026; F04B 43/025; F04B 43/043; F04B 17/03; F04B 39/121; F04B 39/123; F04B 45/047; F04B 43/04; F04B 35/045; F04B 45/04; F04B 45/043
See application file for complete search history.

(56) References Cited

U.S. PATENT DOCUMENTS 6,257,842 B1 * 7/2001 Kawasaki ..... F04B 39/0055 181/229
6,382,935 B1 * 5/2002 Mikiya ..... F04B 45/047 417/413.1
7,322,801 B2 * 1/2008 Li ..... A47C 27/082 417/363
2005/0254971 A1 * 11/2005 Ohya ..... F04B 45/047 417/413.1
2009/0081058 A1 * 3/2009 Ishibashi ..... F04B 35/045 417/417
2012/0230850 A1 * 9/2012 Kawano ..... F04C 11/008 417/410.1

FOREIGN PATENT DOCUMENTS

| | | | |
|---|---|---|---|
| JP | 5490608 | A | 7/1979 |
| JP | 3004918 | U | 12/1994 |
| JP | H07279852 | | 10/1995 |
| JP | 10318151 | A | 12/1998 |
| JP | 2003269339 | A | 9/2003 |
| JP | 2003343446 | | 12/2003 |
| JP | 2008150959 | A | 7/2008 |

OTHER PUBLICATIONS

International Preliminary Report on Patentability, App PCT/JP2012/059649 dated Oct. 15, 2013.

* cited by examiner (a)

(b)

ELECTROMAGNETIC VIBRATING DIAPHRAGM PUMP

CROSS-REFERENCE TO RELATED APPLICATIONS

This application is the National Stage of International Application No. PCT/JP2012/059649 International Filing date, 9 Apr. 2012, which designated the United States of America, and which International Application was published under PCT Article 21 (s) as WO Publication 2012/141126 A1 and which claims priority from, and the benefit of, Japanese Application No. 2011-091462 filed 15 Apr. 2011, the disclosures of which are incorporated herein by reference in their entireties.

BACKGROUND

The presently disclosed embodiment relates to an electromagnetic vibrating diaphragm pump for suctioning and discharging fluid such as air by vibrating an oscillator having a magnet by means of AC drive of an electromagnet so as to vibrate the diaphragms fixed to the both ends of the oscillator. More particularly, it relates to an electromagnetic vibrating diaphragm pump capable of efficiently vibrating the diaphragms and preventing the performance degradation of the pump, even in case the pressure in a compression chamber of a pump casing adjacent to the diaphragm is high, including the case where the gas to be suctioned is pressurized with flammable gas, for example.

Figure 5:
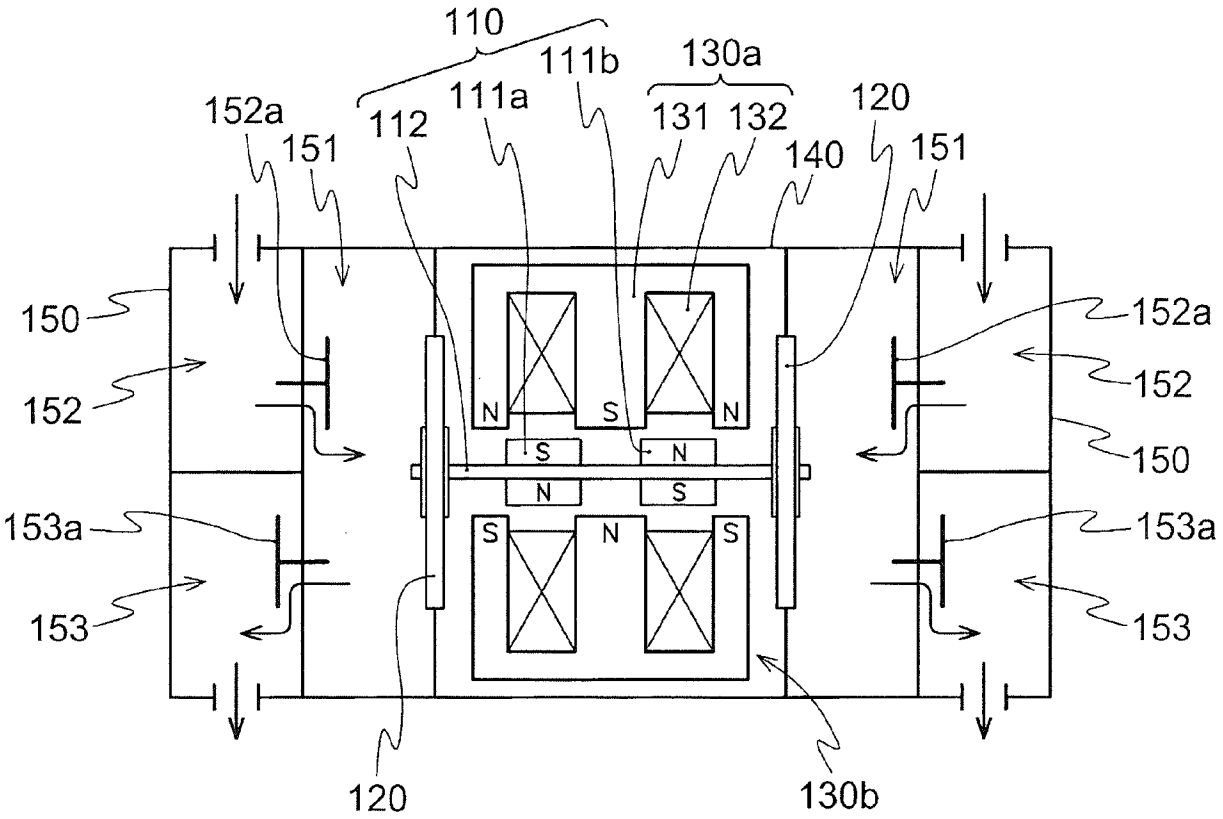

As a schematic view of a diaphragm pump having diaphragms on its both sides, for example, is shown in FIG. 5, the electromagnetic vibrating diaphragm pump is provided with diaphragms 120 made of rubber, etc. fixed on the both ends of an oscillator 110 having two magnets 111*a*, 111*b* made of permanent magnets, etc. fixed to a supporting member 112 and with two electromagnets 130*a*, 130*b* provided in a manner to face the magnets 111*a*, 111*b*. Moreover, a frame 140 is provided in such a manner that the outer peripheries of the diaphragms are fixed to the frame 140 so as to cover the electromagnet 130*a*, 130*b* part, and the outer sides of the diaphragms 120 are covered by pump casings 150 each comprising a compression chamber 151, a suction chamber 152 and an exhaust chamber 153. A suction valve 152*a* is provided between the compression chamber 151 and the suction chamber 152 so that air is injected into from the suction chamber 152 when the pressure in the compression chamber 151 decreases, and an exhaust valve 153*a* is provided between the compression chamber 151 and the exhaust chamber 153 so that the exhaust valve 153*a* opens to discharge air to the exhaust chamber 153 when the pressure in the compression chamber 151 increases (see patent document 1, for example).

In the electromagnetic vibrating diaphragm pump with this structure, assuming two magnets 111*a*, 111*b* are provided on the oscillator 110 with the polarity shown in the drawing, the oscillator 110 moves to the left due to the attraction and repulsion of north pole and south pole of the magnets 111*a*, 111*b*, when current flows into exciting coils 132 so as to generate south pole on the central part of an E-shaped iron core 131 of the electromagnet 130*a* located on the upper side of the drawing and north pole on both sides of the E-shaped iron core. Moreover, when the phase of an AC source is reversed so that the direction of the current is turned in an opposite manner, the south pole and north pole of the electromagnets 130*a*, 130*b* shown in the drawing are reversed so that the oscillator moves to the right this time.

As a result, the oscillator 110 oscillates in accordance with the phase change in the AC source. In this regard, the electromagnet 130*b* located on the lower side of the drawing functions in the manner same as the upper electromagnet, and reversing the direction of the current, such as by reversing the direction of winding the exciting coil and by changing the phase of the AC source to be applied in a manner to differ from that on the upper electromagnet 130*a* by 180 degrees, changes the polarity of the central part of the E-shaped iron core 131 as shown in FIG. 5.

With a focus on a pump casing 150 on the right side of the drawing, for example, when the oscillator 110 moves to the left in the drawing in accordance with this oscillation of the oscillator 110, the diaphragm 120 is also pulled to the left, and the volume of the compression chamber 151 increases so as to open the suction valve 152*a* to allow gas to flow from the suction chamber 152 into the compression chamber 151. Subsequently, when the oscillator 110 moves to the right, the diaphragm 120 is also pulled to the right, and the volume of the compression chamber 151 decreases so as to close the suction valve 152*a* and open the exhaust valve 153*a*, forcing the gas in the compression chamber 151 out into the exhaust chamber 153. By repeating this action, pumping action is performed so as to allow gas and the like of a predetermined amount to be discharged.

Additional background information may be found in Japanese publication JP 2008-150959 A.

SUMMARY

As described above, the electromagnetic vibrating diaphragm pump causes the expansion and contraction of the compression chambers by means of the oscillator driven by an AC source, that is oscillation of the diaphragms so as to discharge gas such as air continuously. However, the diaphragm pump of this type may be used in a manner not only to send out gas in the atmosphere from which air is sent into a usual ornamental tank, etc. but also to suction and discharge gas under a certain amount of pressure such as flammable gas, for example.

In such cases, the pressure inside not only the suction chamber but also the compression chamber increases. Then, the pressure inside the frame is generally the atmosphere pressure and thus a difference in pressure between the frame side and the compression chamber side sandwiching the diaphragm arises. If this pressure difference increases, the diaphragm on its way to move to the compression chamber side is hampered by the pressure in the compression chamber, and sufficient compression can not be performed, which prevents fluid from being discharged.

This invention has been made in order to solve such problem, and the object of this invention is to provide an electromagnetic vibrating diaphragm pump capable of increasing the vibration amplitude of the vibration of a diaphragm and accordingly maintaining high pump efficiency by decreasing the pressure difference between both sides sandwiching the diaphragm even when the pressure inside a compression chamber increases.

The electromagnetic vibrating diaphragm pump of the presently disclosed embodiment comprises an oscillator having a magnet fixed thereto, a diaphragm provided at least on one end portion of the oscillator, an AC driven electromagnet provided in a manner to face the magnets of the oscillator, a frame fixing the outer periphery of the diaphragm and covering the electromagnet side, and a pump casing covering the space on the side opposite to the electromagnet with respect to the diaphragm, the pump casing comprising a compression chamber adjacent to the diaphragm, a suction chamber connected to the compression chambers via a suction valve, and an exhaust chamber connected to the compression chamber via an exhaust valve, the suction chamber and/or the exhaust chamber communicating with the inside of the frame via a continuous hole formed on the sidewalls of the pump casing and the frame.

Sealing the peripheral wall of the frame with such airtightness capable of maintaining the pressure of the gas in the suction chamber or the exhaust chamber is preferred, because it substantially equalizes the pressures of both sides sandwiching the diaphragm, i.e. the pressure inside the frame and the pressure in the compression chamber while maintaining the pressure of the suction chamber or the exhaust chamber, so as to allow the vibration while maintaining large vibration amplitude without hampering the vibration of the diaphragms. As a result, it becomes possible to increase the amount of high pressure discharge, realizing an electromagnetic vibrating diaphragm pump with very good performance.

According to the presently disclosed embodiment, because a suction chamber or an exhaust chamber is formed with such structure as to communicate with the inside of a frame through a continuous hole formed on the side walls of a pump casing and the frame, even in case high pressure is applied to the air to be suctioned into the suction chamber, including for example the case where flammable gas is compressed and supplied, the suction chamber or the exhaust chamber and the frame being connected through the continuous hole formed on each casing cause the pressure substantially equal to the pressure of the suction chamber or the exhaust chamber, i.e. the pressure of the compression chamber to be applied on the frame side of the diaphragm so that there is substantially no pressure difference between both sides sandwiching the diaphragm. As a result, the vibration amplitude produced by the vibration of the diaphragm allows the discharge of gas with a strong discharging force because vibration with large vibration amplitude is possible in the same manner as the case where the pressures of both input side and output side are the atmosphere pressure.

BRIEF DESCRIPTION OF THE DRAWINGS (FIG. 1) A cross-sectional explanatory view of one embodiment of the electromagnetic vibrating diaphragm pump of the presently disclosed embodiment.

Figure 1:
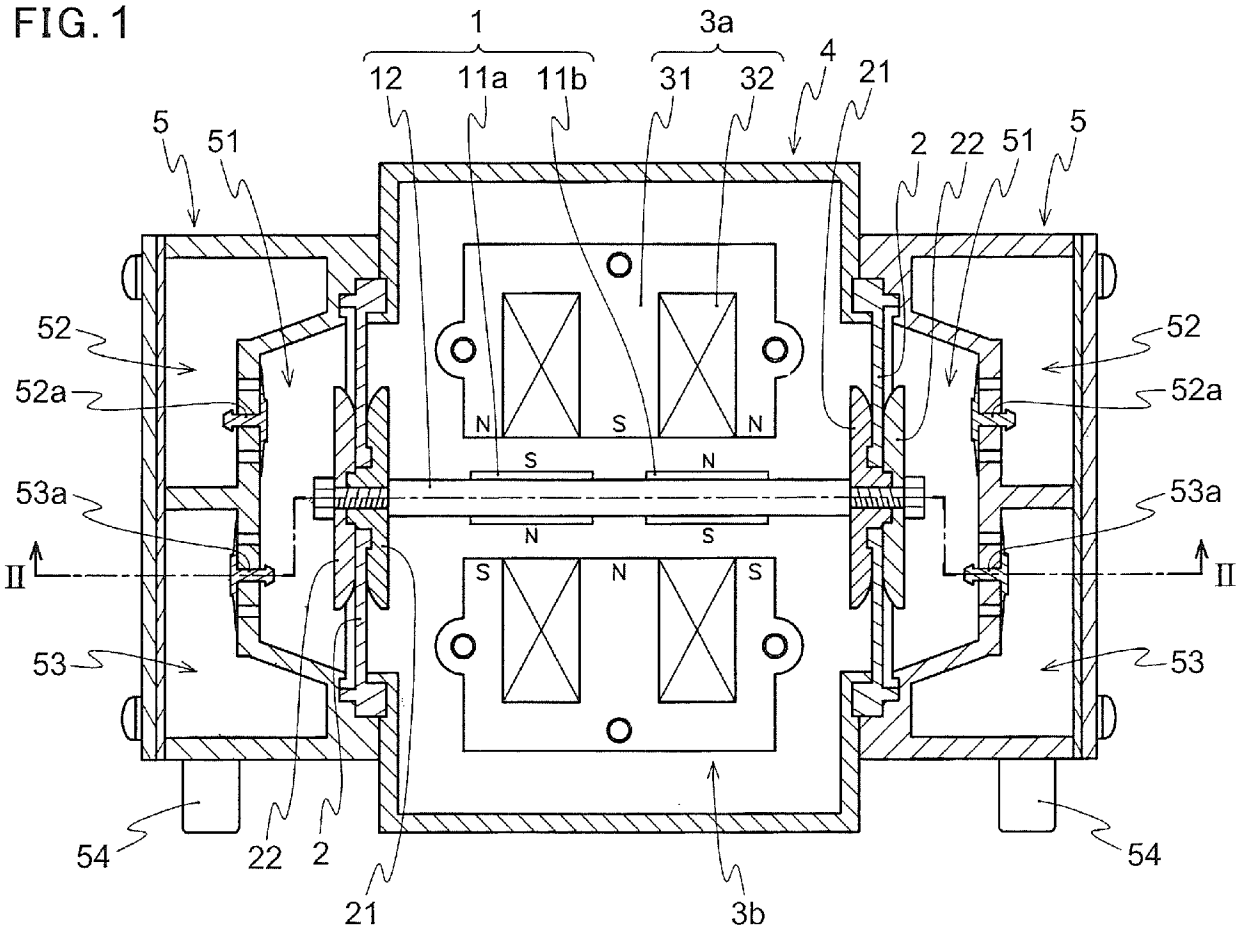

(FIG. 2) A cross-sectional explanatory view taken on line II-II of FIG. 1.

(FIG. 3) An explanatory view of a flow rate measuring system to verify the effect of the presently disclosed embodiment.

(FIG. 4) A view showing the relation of the flow rate to the pressure difference between the suction chamber side and the exhaust chamber side when a continuous hole through the exhaust chamber and the frame according to the presently disclosed embodiment is provided in comparison with a conventional structure.

(FIG. 5) An explanatory view showing the schematic structure of a conventional electromagnetic vibrating diaphragm pump.

DETAILED DESCRIPTION

Next, the electromagnetic vibrating diaphragm pump of the presently disclosed embodiment will be explained with reference to FIG. 1, a horizontal cross-sectional view and FIG. 2, a vertical cross-sectional view taken on line II-II of FIG. 1. In this regard, FIG. 2 does not show electromagnets or the like. In the electromagnetic vibrating diaphragm pump according to the presently disclosed embodiment, an oscillator 1 is formed by fixing magnets 11*a*, 11*b* made of permanent magnets or the like to a plate-like supporting member 12 made of non-magnetic material. A diaphragm 2 is fixed to at least one end portion of this oscillator 1 (on both ends, in the example shown in FIG. 1 and FIG. 2). In addition, AC-driven electromagnets 3*a*, 3*b* are provided in a manner to face the magnets 11*a*, 11*b* of the oscillator 1. The space on the electromagnet 3*a*, 3*b* side is covered by a frame 4 fixed to the outer peripheries of the diaphragms 2 provided on both ends of the oscillator 1, while the spaces on the sides opposite to the electromagnets 3*a*, 3*b* are covered by pump casings 5. This pump casing 5 has a compression chamber 51 adjacent to the diaphragm 2, a suction chamber 52 connected to the compression chamber 51 via a suction valve 52*a*, and an exhaust chamber 53 connected to the compression chamber 51 via an exhaust valve 53*a*. In the presently disclosed embodiment, this suction chamber 52 or exhaust chamber 53 is formed with such structure to communicate with the inside of the frame 4 via a continuous hole 6 formed on the side walls of the frame 4 and the pump casing 5.

The oscillator 1 is formed by fixing the magnets 11*a*, 11*b* made of permanent magnets, etc. to the supporting member 12 formed of a plate-like body made of non-magnetic material, for example. In the example shown in FIG. 1 and FIG. 2, the respective magnets 11*a*, 11*b* are fixed through the supporting member 12 so as to present south pole on one surface side and north pole on the other surface side, but it is also possible to provide two of them on each of the both surfaces of the supporting member 12. Moreover, the magnet(s) can be provided on only one surface instead of both surfaces, possibly with only one of the electromagnets 3*a*, 3*b*, as well.

The electromagnets 3*a*, 3*b* are provided in a manner to face these magnets 11*a*, 11*b*. The electromagnets 3*a*, 3*b* have exciting coils 32 formed by winding electric wires around the central cores of the E-shaped iron core 31, and on application of AC current to the exciting coils 32, the polarity generated at the central cores of the E-shaped iron core 31 changes in accordance with the phase of the AC current. In the example shown in FIG. 1, the electromagnet 3*a* on the upper side of the drawing and the electromagnet 3*b* on the lower side of the drawing are configured such that the end of the central core of the lower electromagnet 3*b* has the polarity, north pole, different from the polarity of the upper electromagnet 3*a* such as by placing the end portion of the exciting coil for supplying current to the exciting coil 32 in the opposite direction, by changing the winding direction of the winding or by applying AC current to be applied to the exciting coil with its phase shifted by 180 degrees. This is because of the polarity difference between the upper side and lower side of the magnets 11*a*, 11*b* of FIG. 1.

In this regard, a ferrite magnet or rare earth magnet, etc. in a form of a plate can be used for these magnets 11*a*, 11*b*. In addition, for example, during the formation of the supporting member 12 by resin molding, etc, they can be adhered firmly to the supporting member 12 by being integrally molded onto the resin of the supporting member 12.

This oscillator 1 has diaphragms 2 formed of, for example, ethylene propylene rubber (EPDM) or fluororubber, etc. mounted to their both ends. The diaphragm 2 has a through-hole at the central part and an inner center plate 21 (provided on the magnet 11*a*, 11*b* side) and an outer center plate 22 (on the pump casings 5 side) are inserted into the through hole and sandwich the diaphragm 2. The diaphragm 2 is fixed to the supporting member 12 by a mounting screw part formed at the ends of the central part of the supporting member 12. Outer periphery of the diaphragm 2 is fixed to the frame 4 and the pump casings 5, and the frame 4 is configured to contain the above-mentioned oscillator 1 and the electromagnets 3*a*, 3*b* therewithin.

The inside of this frame 4 is in such condition as to allow air-tightness inside by covering the inside by, for example, an aluminum thin film adhered to the inner surface of the frame 4 or provided in a manner to closely attach the inner surface thereof, or by sealing by closing the gap of the joint part joining to the frame 4 by means of attachment such as tape and adhesive. In other words, while the suction chamber 52 and/or the exhaust chamber 53 and the inside of the frame 4 communicate with each other, they are sealed with such air-tightness that the pressure of the suction chamber 52 or the exhaust chamber 53 can be maintained.

Moreover, the side opposite to the electromagnets 3*a*, 3*b* with respect to the diaphragm 2 is covered by the pump casing 5. As shown in FIG. 1, this pump casing 5 comprises the compression chamber 51 adjacent to the diaphragm 2, the suction chamber 52 connected to the compression chamber 51 via the suction valve 52*a*, and the exhaust chamber 53 connected to the compression chamber 51 via the exhaust valve 53*a*. Moreover, the exhaust chamber 53 is provided with an exhaust duct 54, configured to lead to a tank or to allow a hose or the like to be connected directly thereto.

The suction valve 52*a* is configured to "open" so as to allow gas from the suction chamber 52 to flow into when the pressure in the compression chamber 51 decreases, and conversely, to "close" so as to prevent gas from flowing to the suction chamber 52 side when the pressure in the compression chamber 51 increases. Moreover, the exhaust valve 53*a* is configured to "open" so as to discharge gas from inside the compression chamber 51 to the exhaust chamber 53 when the pressure in the compression chamber 51 increases, and conversely, to "close" so as to prevent gas from flowing from the exhaust chamber 53 to the compression chamber 51 when the pressure in the compression chamber 51 decreases.

In the presently disclosed embodiment, this suction chamber 52 or exhaust chamber 53 communicates with the inside of the frame 4 through a continuous hole 6 formed on the partition wall of the frame 4 and the pump casing 5. In the example shown in FIG. 1 and FIG. 2, the continuous hole 6 for allowing the exhaust chamber 53 and the inside of the frame 4 to communicate with each other is formed as shown in FIG. 2. The size of this continuous hole 6 is not limited and can be large or small, because the frame 4 is sealed air-tightly inside. Therefore, the communication structure may be a structure forming a notch on the partition wall of the frame 4 and pump casing 5 is acceptable.

The communication only has to be in such condition that gas can move. In other words, a through-hole or a notch does not have to be formed on the corresponding positions of the frame 4 and the pump casing 5, but only has to be lapped partly so as to allow communication. Moreover, in the example shown in FIGS. 1 and 2, the structure is such that both the frame 4 and pump casing 5 have a partition wall, but the partition walls may be one common partition wall instead. In this case, a continuous hole 6 is formed on this one common partition wall. Furthermore, in the example shown in FIGS. 1 and 2, the structure is such that the pump casings 5 are provided at the both sides of the frame 4 and the continuous holes 6 are formed through the pump casings 5 on both sides, however, a continuous hole 6 can be formed through the pump casing 5 only on one pump casing side.

Figure 2:
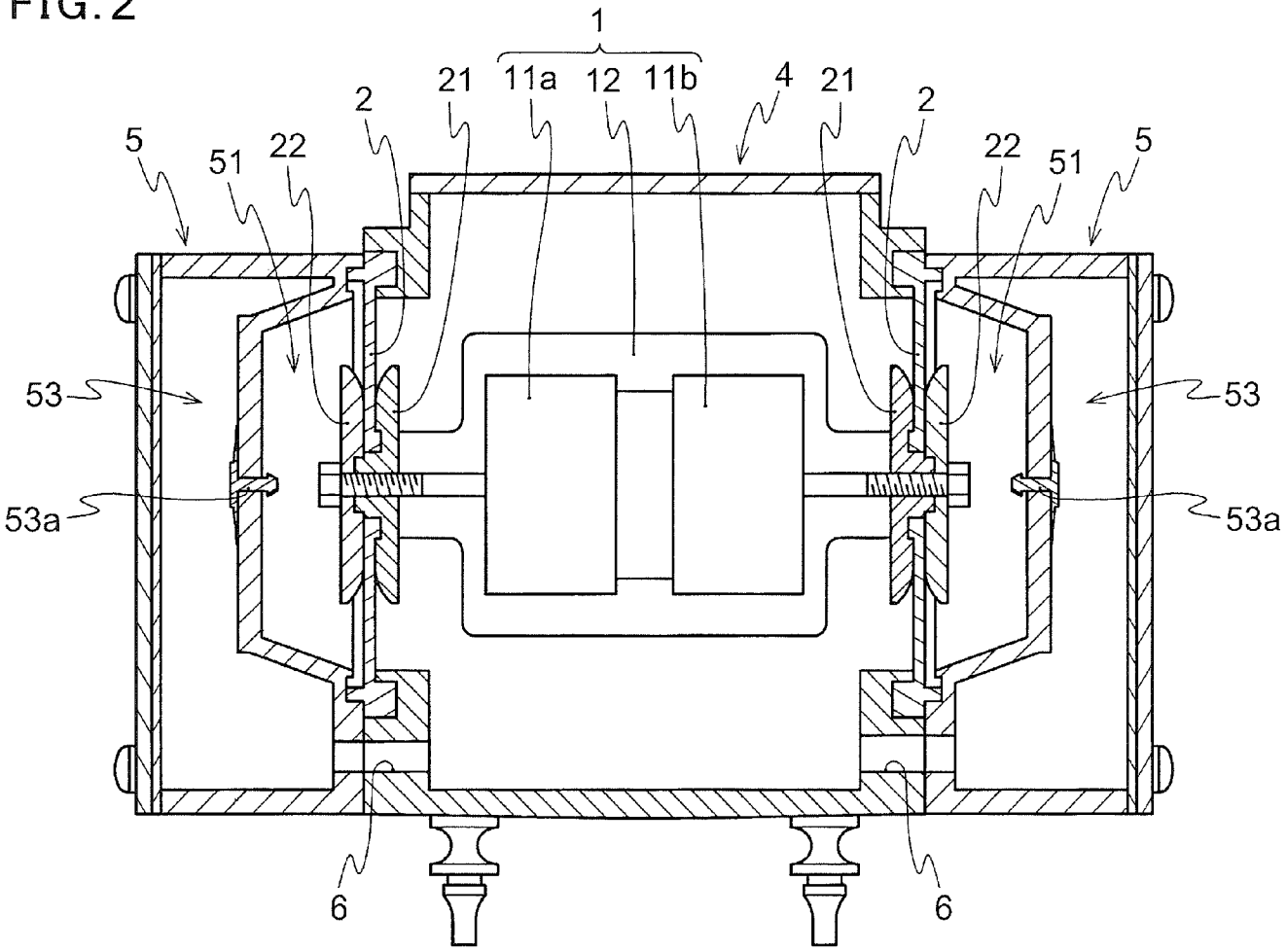

In the example shown in FIG. 2, which is an example configured for allowing the exhaust chamber 53 and the frame 4 to communicate with each other, because pressured gas is supplied to the suction chamber 52, the pressure inside the suction chamber 52 is also high. If a continuous hole is formed so as to allow the suction chamber 52 and the inside of the frame 4 to communicate with each other, the difference in pressure between the spaces on either side of the diaphragm 2 can be relieved.

Next, the performance of this electromagnetic vibrating diaphragm pump will be explained. The magnets 11*a*, 11*b* are fixed to the oscillator 1 with the polarities as shown in FIG. 1 and both electromagnets 3*a*, 3*b* are arranged such that the opposite polarities are generated for the electromagnet 3*a* on the upper side of the drawing and the electromagnet 3*b* on the lower side when AC current is applied to the electromagnets 3*a*, 3*b*. Such opposite polarities can be achieved, for example, by supplying the current from a power source to the exciting coils 32 in a manner to supply it from opposite directions for exciting coils 32 of the two electromagnets 3*a*, 3*b*, by reversing the way of winding the exciting coil 32, by applying currents to the two exciting coils 32 with the phases of the applied currents shifted by 180 degrees from each other and so on.

On applying AC current to such electromagnets 3*a*, 3*b*, south pole or north pole is generated alternately at the end of the central core of the E-shaped iron core 31 in accordance with the phase of AC current, and the opposite polarity, namely north pole or south pole, is generated alternately at the electromagnet 3*b* on the lower side of the drawing. As shown in FIG. 1, when the polarity of the end of the central core of the electromagnet 3*a* is south pole, south pole of the magnet 11*a* of the oscillator 1 repels and north pole of the magnet 11*b* is attracted, so that the oscillator 1 moves to the left in the drawing. Then, with the focus on the pump casing 5 on the right side of FIG. 1, the diaphragm 2 also moves to the left because it is fixed to the oscillator 1, and the compression chamber 51 expands. As a result, the pressure in the compression chamber 51 decreases, the suction valve 52*a* "opens", and gas flows from the suction chamber 52 into the compression chamber 51.

When the direction of the current is reversed due to the change in the phase of AC current by 180 degrees, the polarity of the end of the central core of the electromagnet 3*a* on the upper side of the drawing becomes north pole. Then, because the south pole of the magnet 11*a* is attracted and the north pole of the magnet 11*b* is repelled, the oscillator 1 moves to the right. As a result, the diaphragm 2 on the pump casing 5 side on the right side of the drawing moves to the right, deceasing the volume of the compression chamber 51. As a result, the pressure inside the compression chamber 51 increases, the exhaust valve 53*a* "opens", and gas inside the compression chamber 51 is discharged into the exhaust chamber 53. This sequence of actions is performed in one cycle of the AC source and air is discharged in accordance with the frequency of the AC source. Here, the pump casing 5 on the right side of the drawing only was explained, but because the diaphragm 2 on the left side moves in the same manner as the diaphragm 2 on the right side, the pump casing 50 on the left side operates in the same manner except that expansion and contraction of the compression chamber 51 is opposite to the movement of compression chamber 51 on the right. Furthermore, as far as electromagnet 3*a* is concerned, the only the electromagnet 3*a* on the upper side of the drawing was explained, but because the electromagnet 3*b* on the lower side is configured in a manner to generate opposite polarity in synchronization with the electromagnet 3*a* on the upper side as described above, the oscillator 1 operates in the same manner because of the polarity of the permanent magnets 11*a*, 11*b* being also opposite to the one on the upper side.

For example when pressurized gas is supplied to the suction chamber 52 on this electromagnetic vibrating diaphragm pump, the pressure in the compression chamber 51 also increases necessarily. Then, when the pressure inside the frame 4 is the atmosphere pressure, pressure difference between the frame 4 side and the compression chamber 51 side as seen from the diaphragm 2 becomes larger. In that case, for example, with the focus on the pump casing 5 on the right side of the drawing, when the oscillator 1 moves to the right so as to decrease the volume inside the compression chamber 51, it is necessary to press the diaphragm 2 to the side having higher pressure. In this case, diaphragm 2 is prevented from moving sufficiently. Then, the vibration amplitude of the diaphragm 2 becomes smaller, making it impossible to provide sufficient pump performance. However, in the presently disclosed embodiment, since the exhaust chamber 53 and the frame 4 communicate with each other, the pressure in the frame 4 is substantially equalized with the pressure in the exhaust chamber 53, that is, the pressure in the compression chamber 51, the pressure difference between the both sides of the diaphragm becomes small. Therefore, it is possible to vibrate the diaphragm 2 with the vibration amplitude of the vibration substantially same as that of a diaphragm of a case where pressurized gas is not used.

Figure 3:
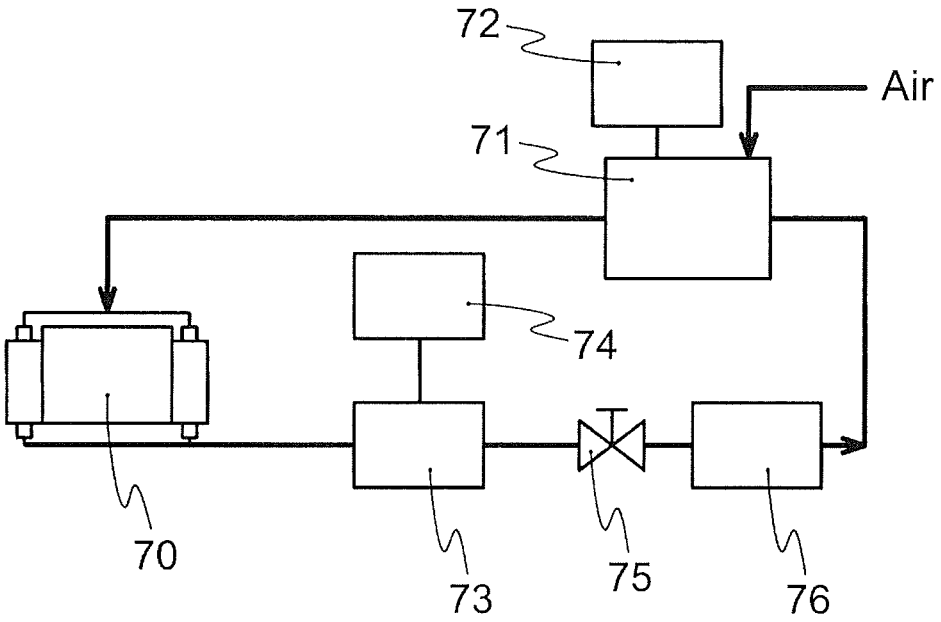

The effects of the electromagnetic vibrating diaphragm pump with the continuous hole 6 formed thereon of the presently disclosed embodiment and a conventional electromagnetic vibrating diaphragm pump with a structure of not comprising a continuous hole 6 were examined by comparing their flow rates. As shown in FIG. 3, a measuring system for examining those effects is configured such that the air to be supplied to a suction chamber of an electromagnetic vibrating diaphragm pump 70 is supplied under a predetermined pressure from a tank 71 having a volume of 5 L (liters) and having a pressure meter 72 mounted thereto and the air discharged from an exhaust chamber of the pump 70 is held in a measuring tank 73 having a volume of 1000 cc, so as to measure the flow rate at a mass flow meter 76 after passing through a needle valve 75. This measuring tank 73 also has a pressure meter 74 mounted thereto so that the pressure of the air to be sent out can be measured as well. In this regard, CMS00200 of Yamatake Corporation was used as the mass flow meter 76.

In the electromagnetic vibrating diaphragm pump of presently disclosed embodiment as shown in FIG. 2 in which the exhaust chamber 53 communicates with the inside of the frame 4 via a continuous hole 6, for the case where the pressure (additional pressure) of the air supplied into the suction chamber 52 is 0 kPa (G) and the case where it is about 30 kPa (G), the flow rate (NL (normal liter)/minute) under different pressures (output pressure adjusted by the needle valve 75) on an exhaust side as well as the voltage and current applied to the electromagnet at that time and also power consumption were measured and shown respectively in Table 1 (additionally applied pressure on suction air is 0 kPa (G)) and Table 2 (additionally applied pressure on suction air is about 30 kPa (G)).

TABLE 1

| Pressure on suction side (kPa(G)) | Pressure on exhaust side (kPa(G)) | Flow rate (NL/min) | Voltage (Vac) | Current (A) | Power consumption (W) | dp (kPa(G)) |
|---|---|---|---|---|---|---|
| 0.0 | 0.7 | 105.9 | 34.86 | 6.228 | 111.38 | 0.7 |
| 0.0 | 10.0 | 86.6 | 34.84 | 5.796 | 126.24 | 10.0 |
| 0.0 | 16.0 | 74.3 | 34.84 | 5.398 | 126.70 | 16.0 |
| 0.0 | 20.0 | 67.7 | 34.85 | 5.131 | 124.52 | 20.0 |
| 0.0 | 22.0 | 64.2 | 34.85 | 4.994 | 123.10 | 22.0 |
| 0.0 | 30.0 | 46.0 | 34.87 | 4.404 | 112.12 | 30.0 |
| 0.0 | 49.0 | 0.0 | 34.94 | 3.132 | 66.78 | 49.0 |

TABLE 2

| Pressure on suction side (kPa(G)) | Pressure on exhaust side (kPa(G)) | Flow rate (NL/min) | Voltage (Vac) | Current (A) | Power consumption (W) | dp (kPa(G)) |
|---|---|---|---|---|---|---|
| 29.8 | 32.7 | 171.0 | 34.58 | 5.403 | 109.06 | 2.9 |
| 29.4 | 40.0 | 138.0 | 34.58 | 5.016 | 105.80 | 10.6 |
| 30.1 | 47.1 | 108.0 | 34.59 | 4.656 | 98.56 | 17.0 |
| 30.0 | 50.0 | 94.8 | 34.60 | 4.496 | 94.87 | 20.0 |
| 30.0 | 52.0 | 89.9 | 34.60 | 4.431 | 93.77 | 22.0 |
| 29.7 | 60.1 | 63.3 | 34.65 | 4.081 | 84.79 | 30.4 |
| 29.8 | 78.7 | 0.0 | 34.66 | 3.564 | 57.79 | 48.9 |

Figure 4:
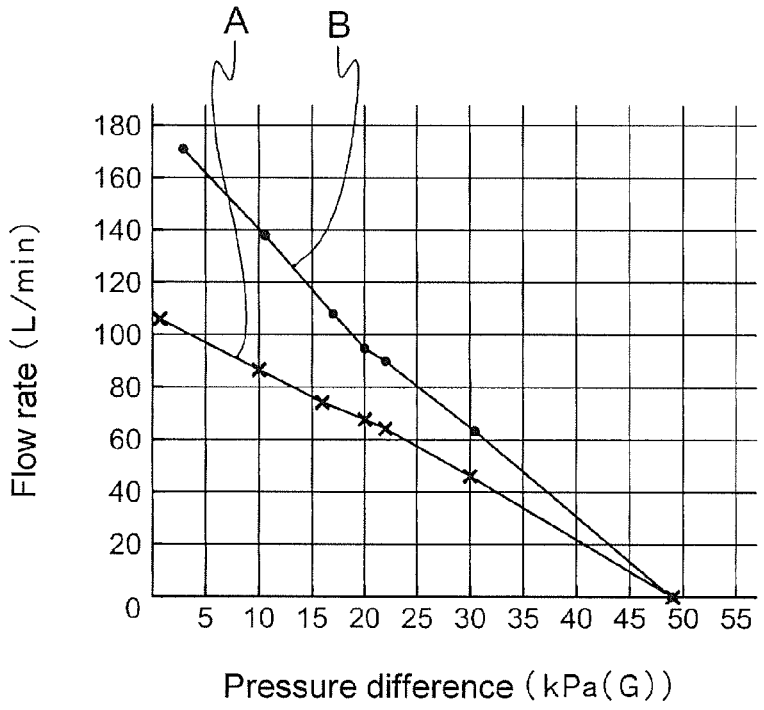
Figure 4:
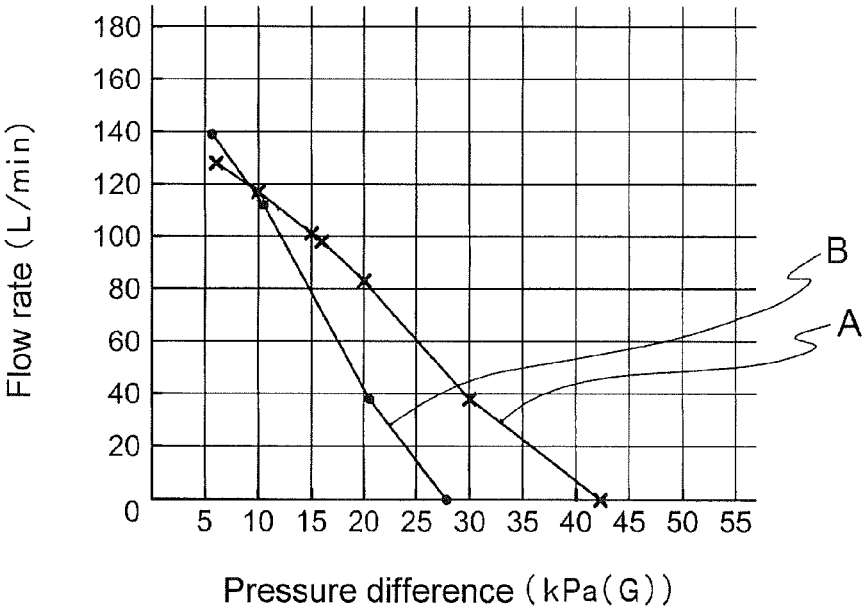

The relation of the flow rate to the pressure difference (dp) between the additionally applied pressure on the suction side and the pressure on the exhaust side in this Table is shown in FIG. 4 (*a*) for the case (A) where the additionally applied pressure on the suction side is 0 kPa (G) and for the case (B) where additionally applied pressure on the suction side is about 30 kPa (G).

Furthermore, as a comparison example, similar measurement was performed with an electromagnetic vibrating diaphragm pump with a conventional structure of not being provided with a continuous hole, for the case where additionally applied pressure on the suction side is 0 kPa (G) (Table 3) and for the case where additionally applied pressure on the suction side is 30 kPa (G) (Table 4). Moreover, in the same manner as the presently disclosed embodiment, the change in the flow rate relative to the pressure difference at that time is shown in FIG. 4 (*b*) in the same manner.

TABLE 3

| Pressure on suction side (kPa(G)) | Pressure on exhaust side (kPa(G)) | Flow rate (NL/min) | Voltage (Vac) | Current (A) | Power consumption (W) | dp (kPa(G)) |
|---|---|---|---|---|---|---|
| 0.0 | 6.1 | 128 | 33.62 | 5.504 | 103.37 | 6.1 |
| 0.0 | 10.0 | 117 | 33.70 | 5.170 | 99.87 | 10.0 |
| 0.0 | 15.0 | 101 | 33.78 | 4.708 | 92.53 | 15.0 |
| 0.0 | 16.0 | 98 | 33.80 | 4.610 | 90.62 | 16.0 |
| 0.0 | 20.0 | 83 | 33.90 | 4.216 | 80.68 | 20.0 |
| 0.0 | 30.0 | 38 | 34.18 | 3.460 | 48.97 | 30.0 |
| 0.0 | 42.3 | 0 | 34.42 | 3.455 | 20.61 | 42.3 |

TABLE 4

| Pressure on suction side (kPa(G)) | Pressure on exhaust side (kPa(G)) | Flow rate (NL/min) | Voltage (Vac) | Current (A) | Power consumption (W) | dp (kPa(G)) |
|---|---|---|---|---|---|---|
| 30.0 | 35.7 | 139 | 33.90 | 4.865 | 78.08 | 5.7 |
| 29.7 | 40.2 | 112 | 33.97 | 4.519 | 68.92 | 10.5 |

TABLE 4-continued

| Pressure on suction side (kPa(G)) | Pressure on exhaust side (kPa(G)) | Flow rate (NL/min) | Voltage (Vac) | Current (A) | Power consumption (W) | dp (kPa(G)) |
|---|---|---|---|---|---|---|
| 29.5 | 50.0 | 38 | 34.27 | 4.125 | 37.62 | 20.5 |
| 29.0 | 56.8 | 0 | 34.40 | 4.238 | 23.37 | 27.8 |

As is clear from FIGS. 4 (*a*) and (*b*), the flow rate of the pump according to the presently disclosed embodiment is improved with considerable increase in case the additionally applied pressure on the suction chamber side is 30 kPa (G) compared with the case where the additionally applied pressure on the suction side is 0 kPa (G) (B in FIG. 4 (*a*)), whereas it is shown that the performance of the conventional pump is significantly deteriorated in case the additionally applied pressure is 30 kPa compared to the case where the additionally applied pressure is 0 kPa (G). Moreover, it is clear that the performance of a pump with a conventional structure deteriorates when the additionally applied pressure on the suction chamber side is 0 and the pressure on the exhaust side is 30 kPa (G) or more, presenting the effect of the presently disclosed embodiment. Therefore, the effect of the presently disclosed embodiment emerges very obviously when pressurized gas is used as the gas to be supplied to the suction chamber, and the effect emerges by employing the structure of the presently disclosed embodiment if the pressure on the exhaust side is high, even without pressurized gas being supplied.

EXPLANATION OF SYMBOLS

1 Oscillator
2 Diaphragm
3*a*, 3*b* Electromagnets
4 Frame
5 Pump casing
6 Continuous hole
11*a*, 11 *b* Magnets
12 Supporting member
31 E-shaped iron core
32 Exciting coil
51 Compression chamber
52 Suction chamber
52*a* Suction valve
53 Exhaust chamber
53*a* Discharge valve
54 Exhaust tube
70 Electromagnetic vibrating diaphragm pump
71 Tank
72 Pressure meter
73 Measuring tank
74 Pressure meter
75 Needle valve
76 Mass flow meter

What is claimed is:

1. An electromagnetic vibrating diaphragm pump comprising:

an oscillator having a magnet fixed thereto;

a diaphragm provided at least on one end portion of the oscillator;

an electromagnet provided in a manner to face the magnet of the oscillator the electromagnet being AC-driven;

a frame fixing the outer periphery of the diaphragm so as to directly support the diaphragm and covering the electromagnet; and a pump casing covering a space opposite the electromagnet with respect to the diaphragm, wherein the pump casing comprises, within the pump casing, a compression chamber adjacent to the diaphragm, a suction chamber connected to the compression chamber via a suction valve, and an exhaust chamber connected to the compression chamber via an exhaust valve, and an interior of the exhaust chamber being directly connected with an inside of the frame via a continuously open hole formed on side walls of the pump casing and the frame, wherein the interior of the exhaust chamber is further connected directly, so as to define a direct communication with an exterior of the pump independent of the direct connection with the inside of the frame, with an exhaust duct configured to lead a gas from the exhaust chamber directly to the exterior of the pump through the exhaust duct, the suction chamber communicates with a pressurized gas, and the diaphragm is interposed between the frame and the compression chamber which compresses the pressurized gas, and the frame is sealed as to maintain a gas pressure of the exhaust chamber.

2. The electromagnetic vibrating diaphragm pump according to claim 1, wherein the frame is sealed by providing an aluminum thin film on the inner surface of the frame.

3. The electromagnetic vibrating diaphragm pump according to claim 1, wherein the frame is sealed by closing a gap of a joint part joining to the frame by a tape or an adhesive.

4. The electromagnetic vibrating diaphragm pump according to any one of claim 1, wherein the continuously open hole is formed by partly lapping a through-hole or a notch formed on the side walls of the pump casing and the frame.

5. The electromagnetic vibrating diaphragm pump according to any one of claim 1, wherein the side walls of the pump casing and the frame are configured as one common partition wall between the frame and the pump casing, and the continuously open hole is formed on the one common partition wall.

6. The electromagnetic vibrating diaphragm pump according to any one of claim 1, wherein the diaphragm is configured by a molded body of ethylene propylene rubber (EPDM) or fluoro-rubber.

7. The electromagnetic vibrating diaphragm pump according to any one of claim 1, wherein the magnet is a permanent magnet made of a ferrite magnet or a rare earth magnet in a form of a plate.

8. The electromagnetic vibrating diaphragm pump according to claim 7, wherein the oscillator comprises a supporting member of molded resin, and the magnet is provided integrally with the molded resin supporting member.

* * * * *